US007619519B2

(12) United States Patent
Richter

(10) Patent No.: US 7,619,519 B2
(45) Date of Patent: Nov. 17, 2009

(54) ALARM MODULE FOR PROTECTING WALL-HUNG OBJECTS FROM TAMPER OR THEFT

(76) Inventor: Robert S. Richter, Studio, 24 Old Rock Rd., Weston, CT (US) 06883-2554

( * ) Notice: Subject to any disclaimer, the term of this patent is extended or adjusted under 35 U.S.C. 154(b) by 420 days.

(21) Appl. No.: 11/525,546

(22) Filed: Sep. 21, 2006

(65) Prior Publication Data

US 2007/0069911 A1 Mar. 29, 2007

Related U.S. Application Data

(60) Provisional application No. 60/720,011, filed on Sep. 23, 2005.

(51) Int. Cl.
*G08B 13/14* (2006.01)

(52) U.S. Cl. ..... 340/568.8; 340/568.1; 340/571; 70/57.1

(58) Field of Classification Search ..... 340/568.1, 340/572.1, 568.2, 568.8, 571; 70/57.1
See application file for complete search history.

(56) References Cited

U.S. PATENT DOCUMENTS

| | | | | |
|---|---|---|---|---|
| 3,668,680 | A | 6/1972 | Spalding et al. | |
| 3,760,402 | A * | 9/1973 | Magerle et al. | 340/568.8 |
| 4,274,088 | A | 6/1981 | Pierson et al. | |
| 4,458,241 | A | 7/1984 | Frankenberg | |
| 4,499,679 | A * | 2/1985 | Sherman | 40/712 |
| 4,857,892 | A * | 8/1989 | Riordan | 340/568.8 |
| 4,994,793 | A * | 2/1991 | Curtis | 340/666 |
| 5,258,743 | A | 11/1993 | Nelson et al. | |
| 5,610,587 | A * | 3/1997 | Fujiuchi et al. | 340/568.2 |
| 5,638,049 | A | 6/1997 | Arakawa | |
| 5,836,002 | A * | 11/1998 | Morstein et al. | 340/568.1 |
| 6,255,958 | B1 | 7/2001 | Haimovich et al. | |
| 6,380,855 | B1 * | 4/2002 | Ott | 340/568.2 |
| 6,424,261 | B1 | 7/2002 | Williams et al. | |
| 6,686,841 | B1 | 2/2004 | Busch et al. | |
| 2003/0210144 | A1 * | 11/2003 | Ott | 340/568.2 |
| 2004/0145473 | A1 * | 7/2004 | Royer | 340/568.2 |

* cited by examiner

*Primary Examiner*—Eric M Blount
(74) *Attorney, Agent, or Firm*—Ware, Fressola, Van Der Sluys & Adolphson LLP

(57) ABSTRACT

An alarm module is provided that includes a first and second switch, a power source and a signal module for generating an alarm signal. When the first and second switch are both in the closed position, the signal module is activated by power from the power source. The first switch opens when an item associated with the alarm module is placed on or connected to the alarm module, and closes when the item is tampered with or removed. The second switch opens when a key is inserted into the alarm module, and closes when the key is removed from the alarm module. The alarm module may also include a third switch that closes when power flows from the power source to the device, and can only be opened upon insertion of the key into the alarm module.

19 Claims, 10 Drawing Sheets

ALARM MODULE FOR PROTECTING WALL-HUNG OBJECTS FROM TAMPER OR THEFT

CROSS REFERENCE TO RELATED APPLICATION

This application claims priority to U.S. provisional application Ser. No. 60/720,011, filed Sep. 23, 2005, entitled BATTERY-POWERED ALARM MODULE FOR PROTECTING WALL-HUNG OBJECTS FROM TAMPER OR THEFT.

BACKGROUND OF THE INVENTION

The invention relates to wall based alarm modules used for anti-tamper and anti-theft protection of hanging objects, such as artworks or antiques.

Object placed on display, such as pictures and artwork, are susceptible to tamper or theft due to their accessibility to persons. However, it may be difficult to secure items on display in a manner that still allows individuals to have sufficient access so that they may enjoy the artwork, antiques or pictures that are on display. In addition, surveillance equipment used to prevent tampering or theft of items on display may be both expensive and require a great deal of attention from personnel to monitor. Furthermore, alarm systems may be employed to alert personnel of possible theft or tampering, but the alarm systems may be incapable of identifying the individuals responsible if those individuals leave the area.

What is needed is an alarm device that can be securely attached to items on display and capable of producing an audible alarm or generating a signal that results in an audible, so that any theft or tampering of the items on display is immediately apparent.

DISCLOSURE OF INVENTION

According to an aspect of the invention an alarm module is provided, and may include a first switch operatively connected to a switch-trigger mechanism, a second switch operatively connected to a key receiving device, a signal module for generating a signal for producing an alarm, and a power source. At least the first switch, second switch, signal module, and power source may be operatively connected to define an electrical circuit. The first switch may be opened when a force is applied to the switch-trigger mechanism, and the second switch may be opened upon insertion of a key in the key receiving device.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION OF THE INVENTION

Figure 1:
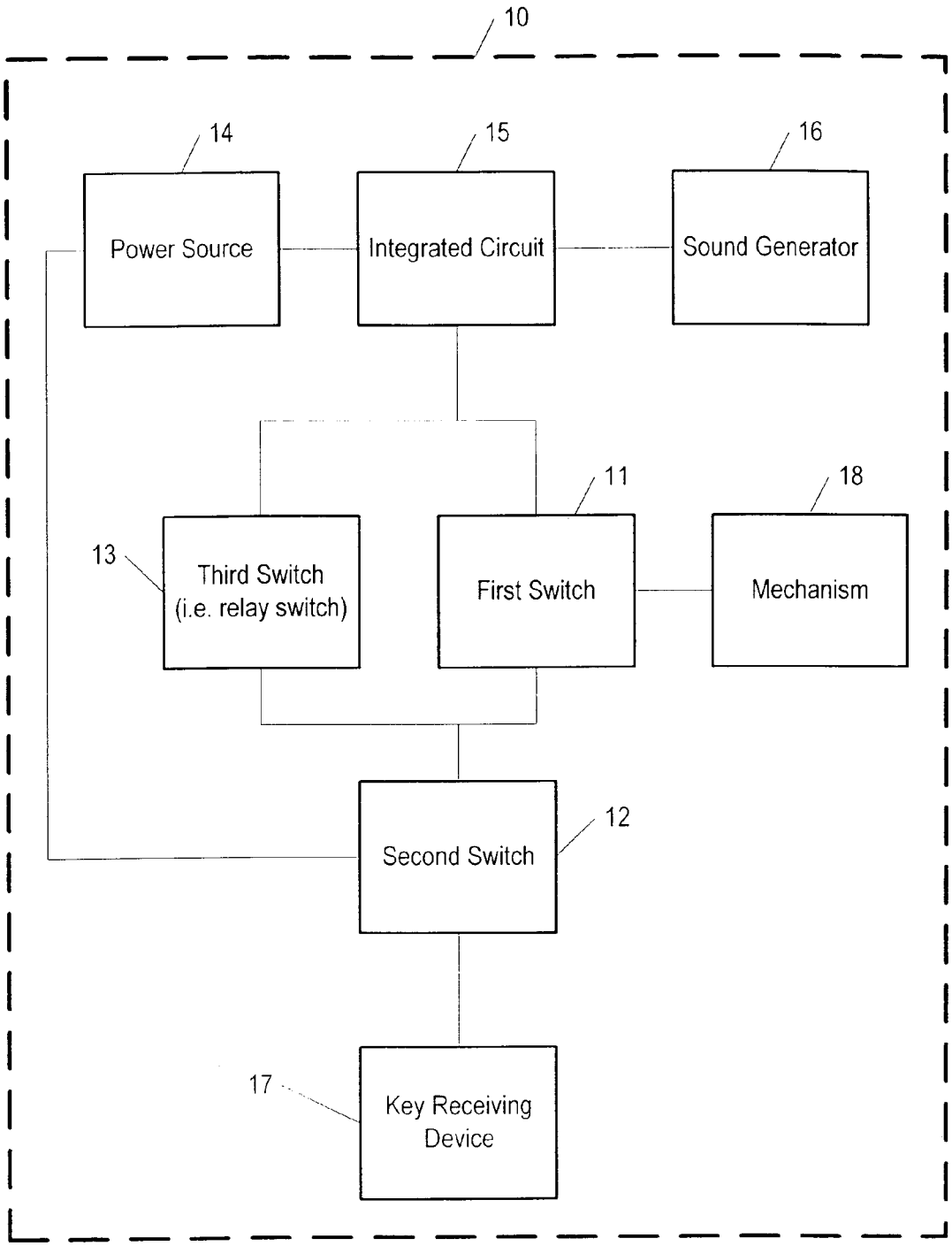
FIG. 1 is a block diagram of an alarm module according to an aspect of the invention.

In an exemplary embodiment of the invention, an alarm module 10 is provided in FIG. 1. The hanging alarm module 10 includes a first switch 11, a second switch 12, a relay switch 13, a power source 14, for example at least one battery, a signal module for generating a signal for producing an alarm, for example an integrated circuit 15, and a sound generator 16, for example a piezo transducer that is configured to be driven by the integrated circuit. The first switch 11, second switch 12, power source 14, integrated circuit 15 and sound generator 16 are configured to define an electrical circuit so that when both the first switch 11 and second switch 12 are closed current flows to the sound generator 16 producing an audible alarm.

The first switch 11 may be operatively coupled to a switch-trigger mechanism 18 configured to receive a hanging device, such as a hanging wire from a picture, or any other sort of clamp, clip, bracket or hook that may be employed to hang an item for display. It is understood that the first switch 11 may include the switch-trigger mechanism 18 so that the first switch 11 and switch-trigger mechanism 18 define a single mechanical switch. The first switch 11 and switch-trigger mechanism 18 may also be separate and distinct items. When a weight is applied to the switch-trigger mechanism 18, such as the weight from a picture attached to the hanging wire, the switch-trigger mechanism 18 operates to open the first switch 11. The first switch 11 is closed when the switch-trigger mechanism 18 is not acted upon by the weight of an item hung from the alarm module 10.

The second switch 12 may be operatively coupled to a key receiving device 17. The key receiving device 17 is configured to receive a key. When the key is inserted into the key receiving device 17, the second switch 12 is opened. When the key is removed from the key receiving device 17 the second switch 12 is closed. The removal of the key will complete the circuit, and thus activate the integrated circuit 15, which in turn activates the sound generator 16 if the first switch 11 is also closed. If, for example, a picture or other display item is hung on the alarm module 10 causing the weight of the picture or display item to act upon the switch-trigger mechanism 18, the sound generator 16 will not be activated upon removal of the key because the first switch 11 is open and the circuit is incomplete. If, for example, the picture or display item is removed from the switch-trigger mechanism 18 the first switch 11 will close completing the circuit, if the key has been removed from the key receiving device 17.

The alarm module 10 may also include a relay switch 13, such as a normally open relay switch, that is configured to close upon completion of the circuit when the first 11 and second 12 switches are closed. The relay switch 13 is configured so that even if the switch-trigger mechanism 18 is actuated by replacing or rehanging the picture or display item on the alarm module 10 after the circuit has been closed, the relay switch 13 will not open. The relay switch 13 is configured to be opened by the insertion of the key in the key receiving device 17 which acts to open the second switch 12. It is understood that the relay switch 13 may be opened upon insertion of the key into the key receiving device 17 due to a mechanical coupling between the relay switch 13 and the key receiving device 17, or due to interruption of current passing through the relay switch 13 by the opening of the second switch 12.

As stated above, the sound generator 16 can be for example a piezo transducer, such as a high decibel, e.g. 130 dB, high frequency piezo transducer. When the circuit is completed either by removal of the key from the key receiving device 17, thus closing the second switch 12 when the first switch 11 is also closed i.e. when the switch-trigger mechanism 18 is not acted upon by the weight of a picture or display item, an electric current from the power source 14 acts on the integrated circuit 15, which operates the piezo transducer to generate an alarm sound. The integrated circuit 15 may include for example a driver configured to drive the piezo transducer. It is also understood that the circuit may be completed and the alarm sound generated when a picture hung by a hanging wire on the alarm module 10 is removed or tampered with, because the removal of weight from the switch-trigger mechanism 18 causes the first switch 11 to close and complete the circuit if the second switch 12 is also closed if the key has been removed from the key receiving device 17.

The power source 14 may be for example at least one battery, including a so-called fuel cell, or a combination of batteries whether in parallel or series. If the power source is a battery or multiple batteries, the battery or batteries may be a dry cell, a mercury cell, a lithium battery, a nickel metal hydride battery, a nickel-cadmium cell, or the like.

Figure 2A:
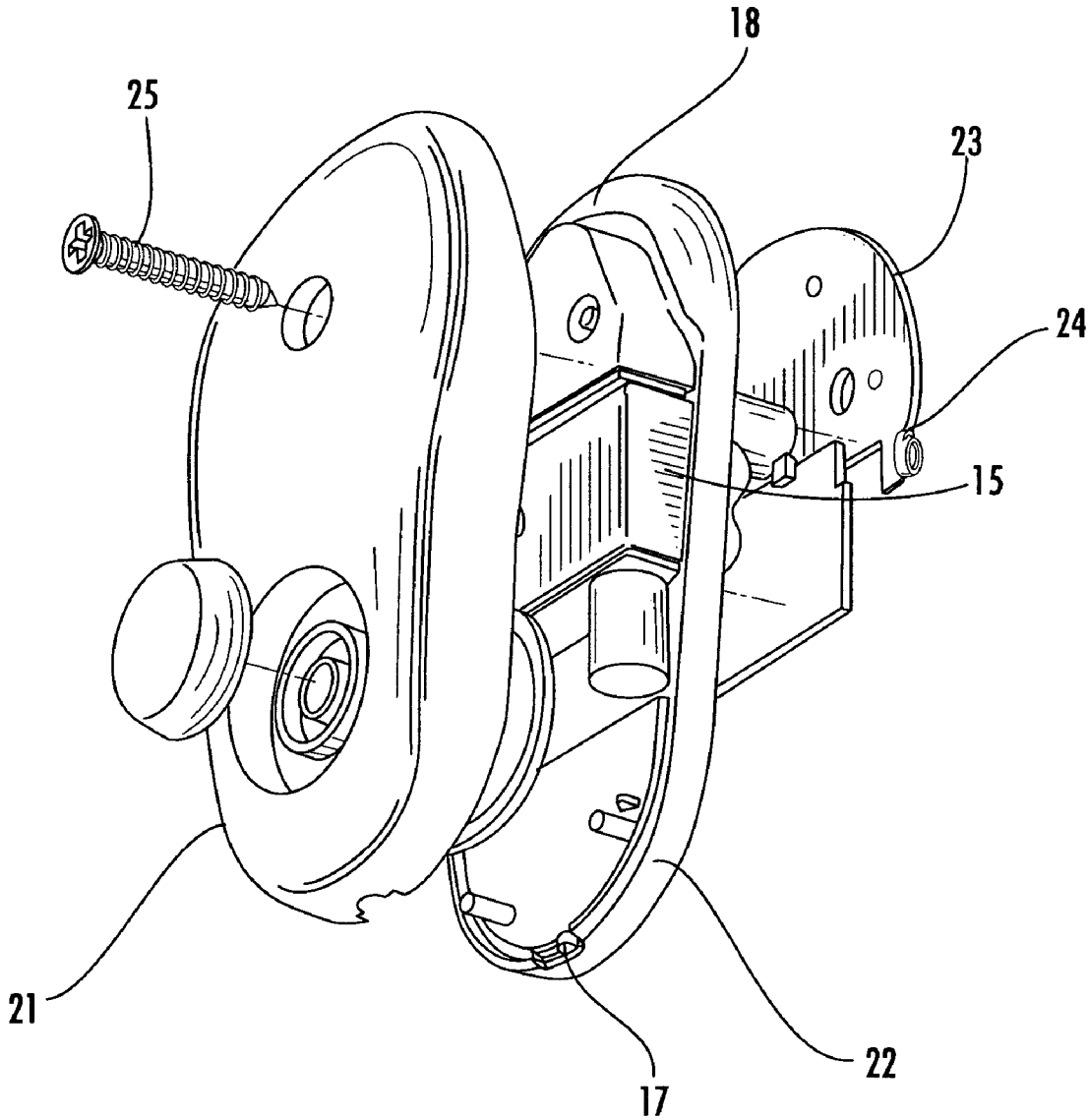
FIG. 2A is an expanded view of an alarm module according to an aspect of the invention.
Figure 2B:
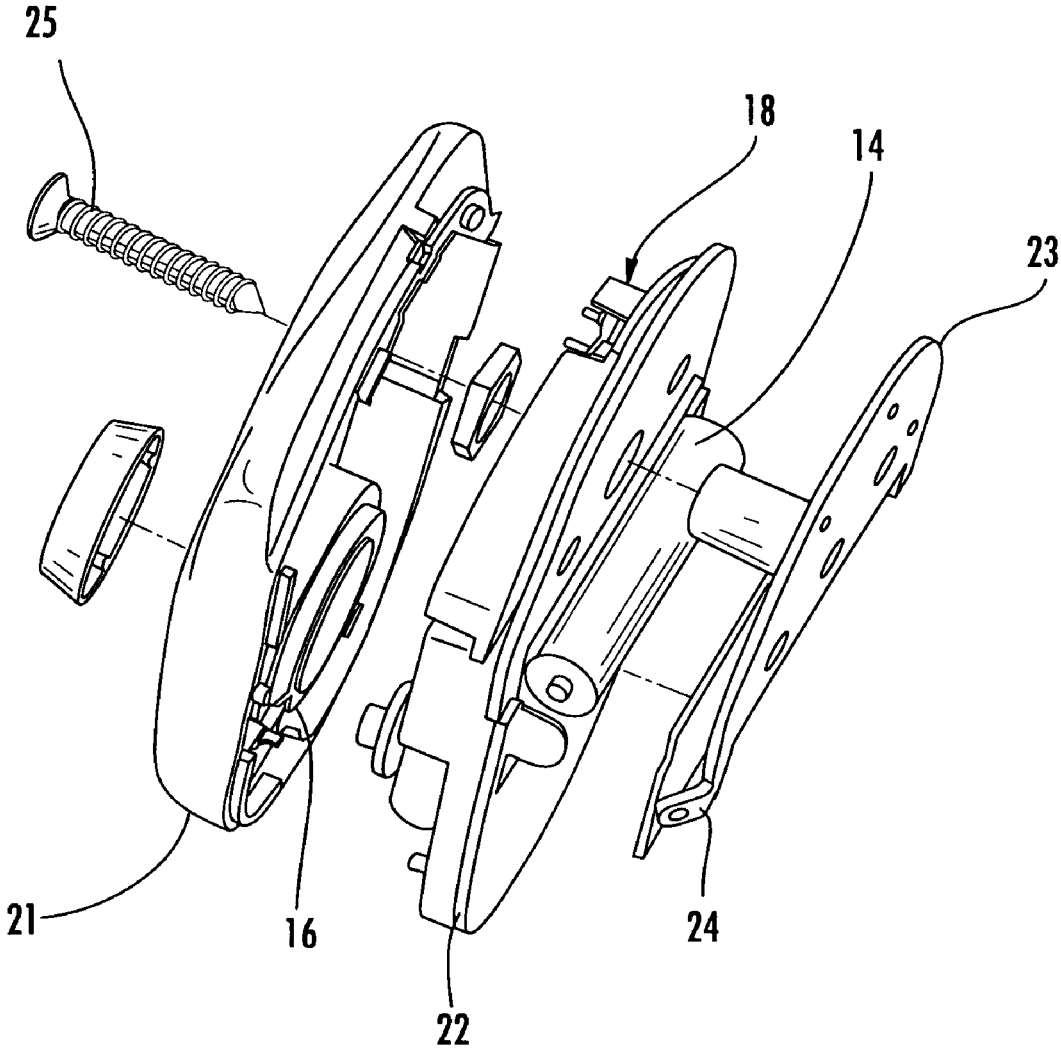
FIG. 2B is an expanded view of an alarm module according to an aspect of the invention.

FIGS. 2A and 2B show an exploded view of the alarm module 10 according to an exemplary embodiment of the invention. As seen in FIG. 2A, the alarm module 10 may include a front cover 21, a back cover 22, and a mounting plate 23. The front cover 21 and back cover 22 may be made from any suitable material, such as plastic. The alarm module 10 may also be configured to receive a mounting device 25, such as a screw for mounting the alarm module 10 on a surface, such as a wall. The mounting plate 23 may include one or more hanging wire clip retaining loops 24. As seen in FIGS. 2A and 2B, the switch-trigger mechanism 18 may be located on the top surface of the alarm module 10 in a slot defined by the front cover 21 and back cover 22 for receiving, for example, a hanging wire. The switch-trigger mechanism 18 would be depressed by the weight of the hanging wire from the picture or other display item, thereby causing the first circuit 11 to open.

Figure 3:
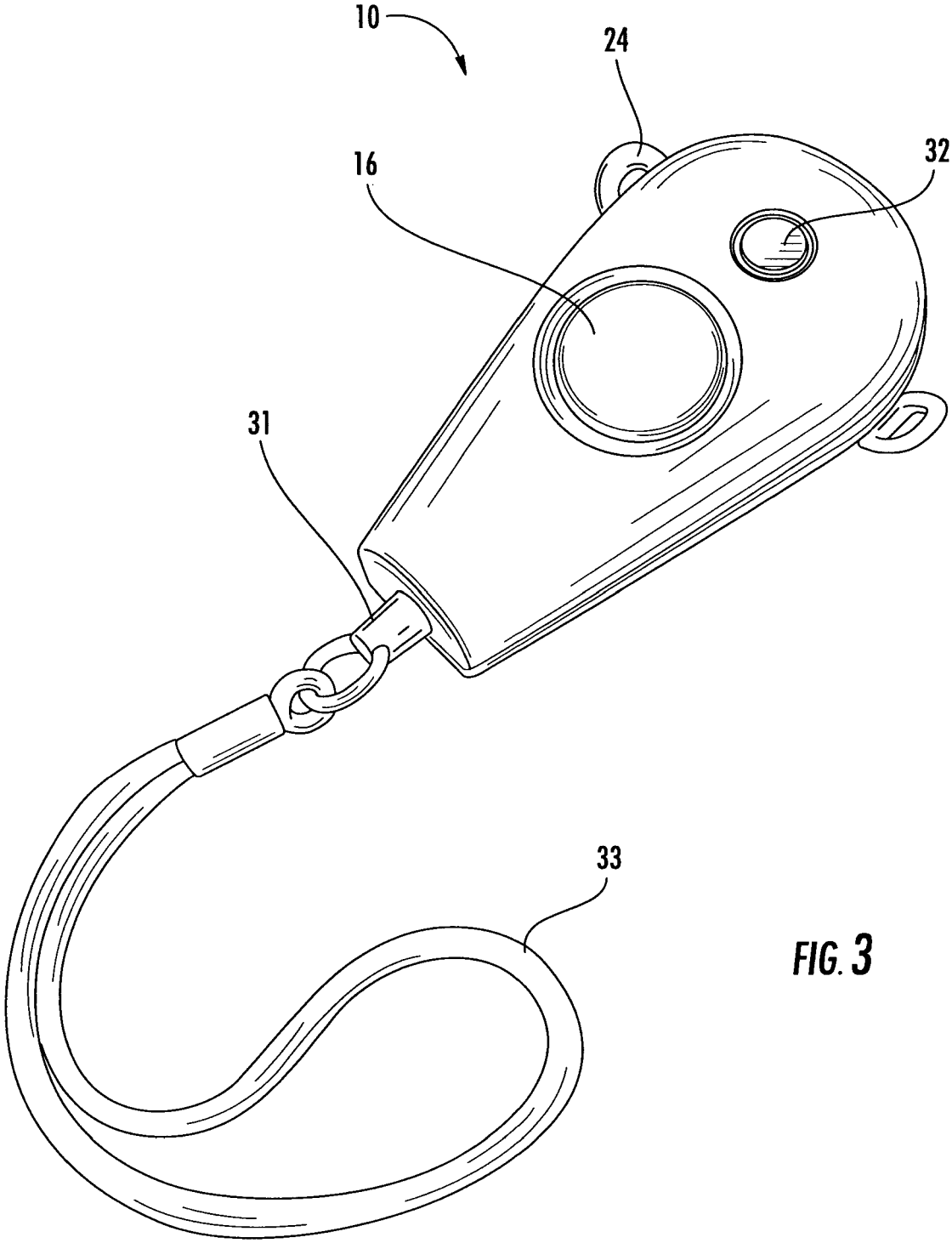
FIG. 3 is a frontal view of an alarm module according to an aspect of the invention.
Figure 4:
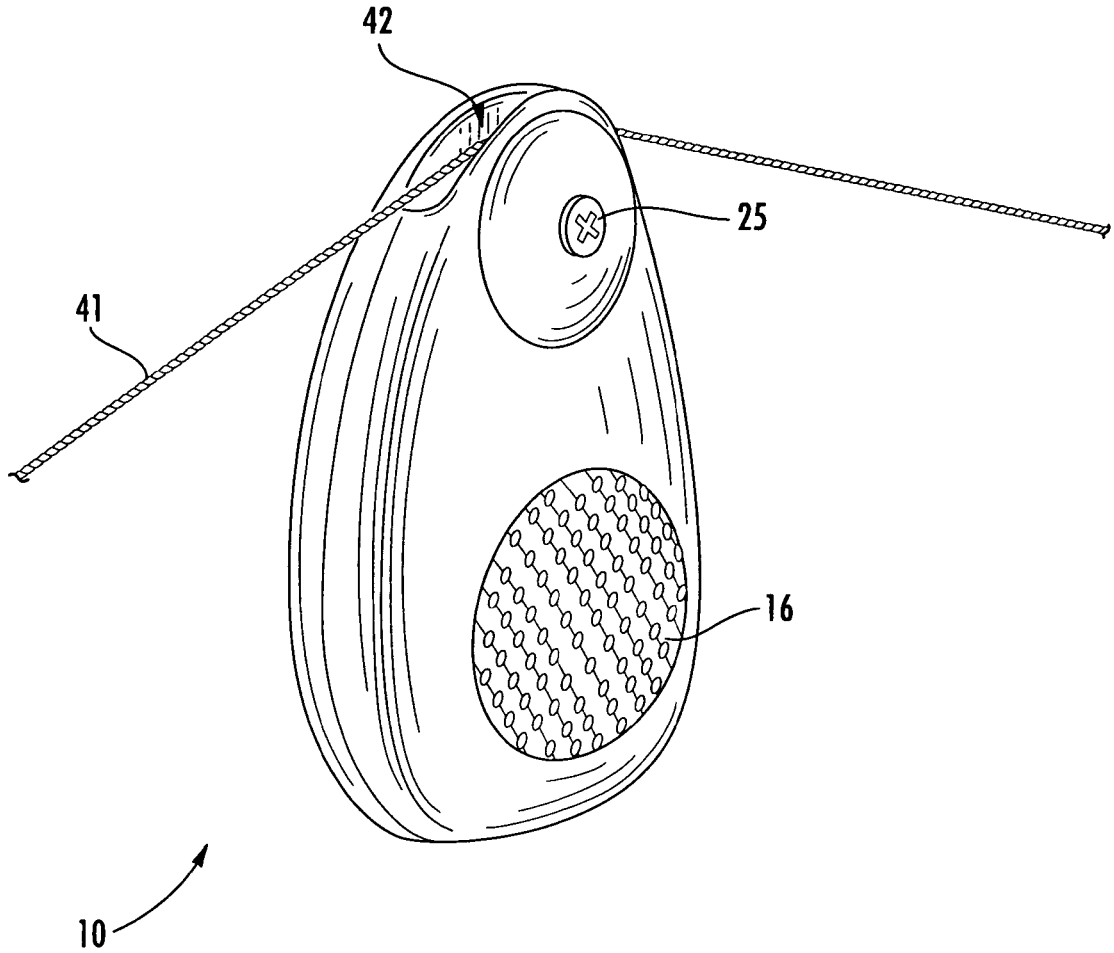
FIG. 4 is view of an alarm module according to an aspect of the invention in an armed state with a key removed and a hanging wire on the alarm module.
Figure 4:
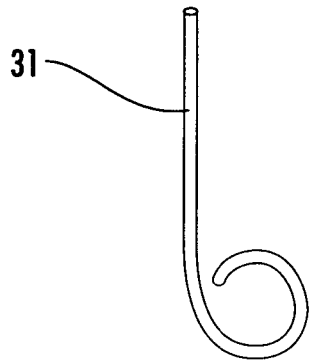
Figure 8:
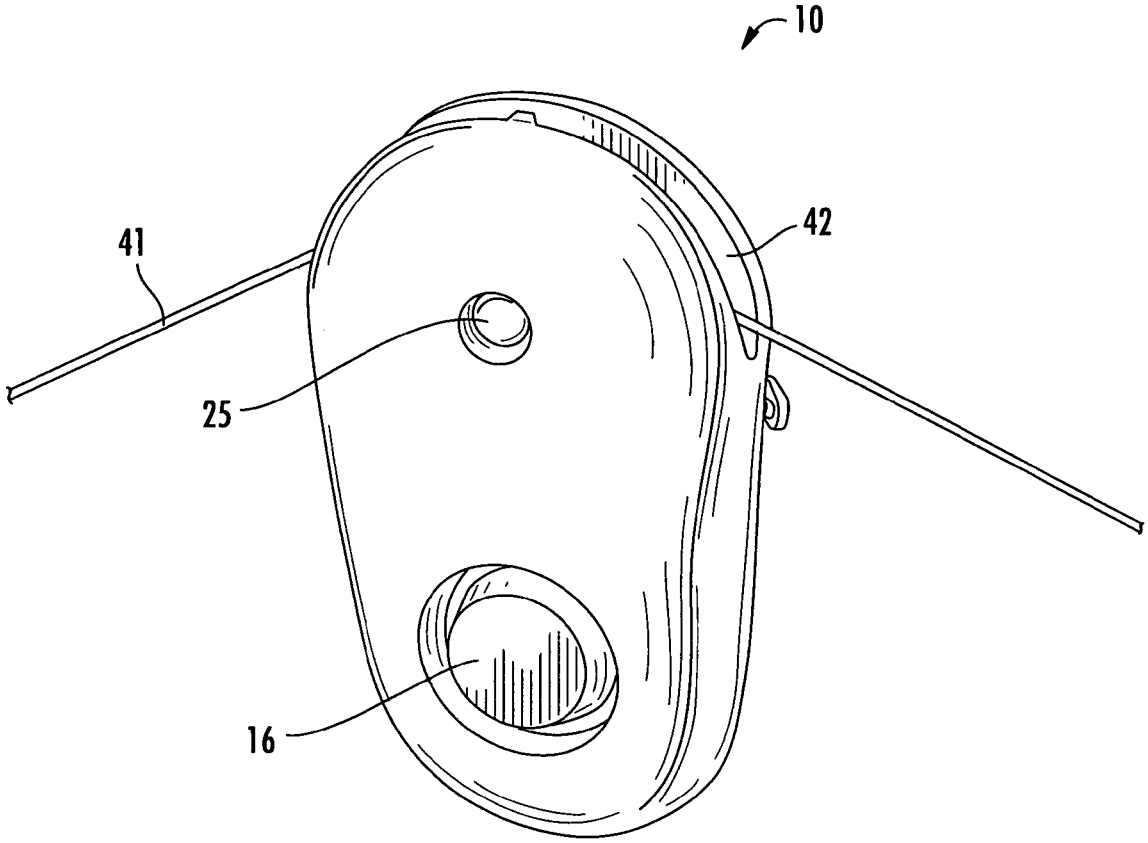
FIG. 8 is view of an alarm module according to an aspect of the invention showing a hanging wire on the alarm module.

FIGS. 3,4 and 8 show exemplary embodiments of the alarm module 10. FIG. 3 shows the alarm module 10 with a key 31 inserted in the key receiving device, and an apparatus 32 defining opening for receiving a mounting device, such as a screw. The key 31 may be attached to a lanyard 33 for ease of removal of the key. FIG. 4 shows another exemplary embodiment of the alarm module 10, in which the key 31 has been removed. FIG. 4 demonstrates how a hanging device 41, such as hanging wire may be placed on the alarm module 10 in a slot 42 configured to retain the hanging device 41. FIG. 8 shows another exemplary embodiment of the alarm module 10 with a hanging device 41 placed in the slot 42 of the alarm module 10. It is understood that the hanging device 41 may be attached to a picture or other display item. In the configuration of the alarm module 10 shown in FIG. 4, with the key 31 removed and the weight from the hanging device 41 acting upon the switch-trigger mechanism, the first switch 11 is in the open position, and the second switch 12 is in the closed position. If the hanging device 41 were removed from the alarm module 10, the first switch 11 would be operated upon by the switch-trigger mechanism 18 to become closed, thus completing the circuit and activating the sound generator 16.

Figure 9:
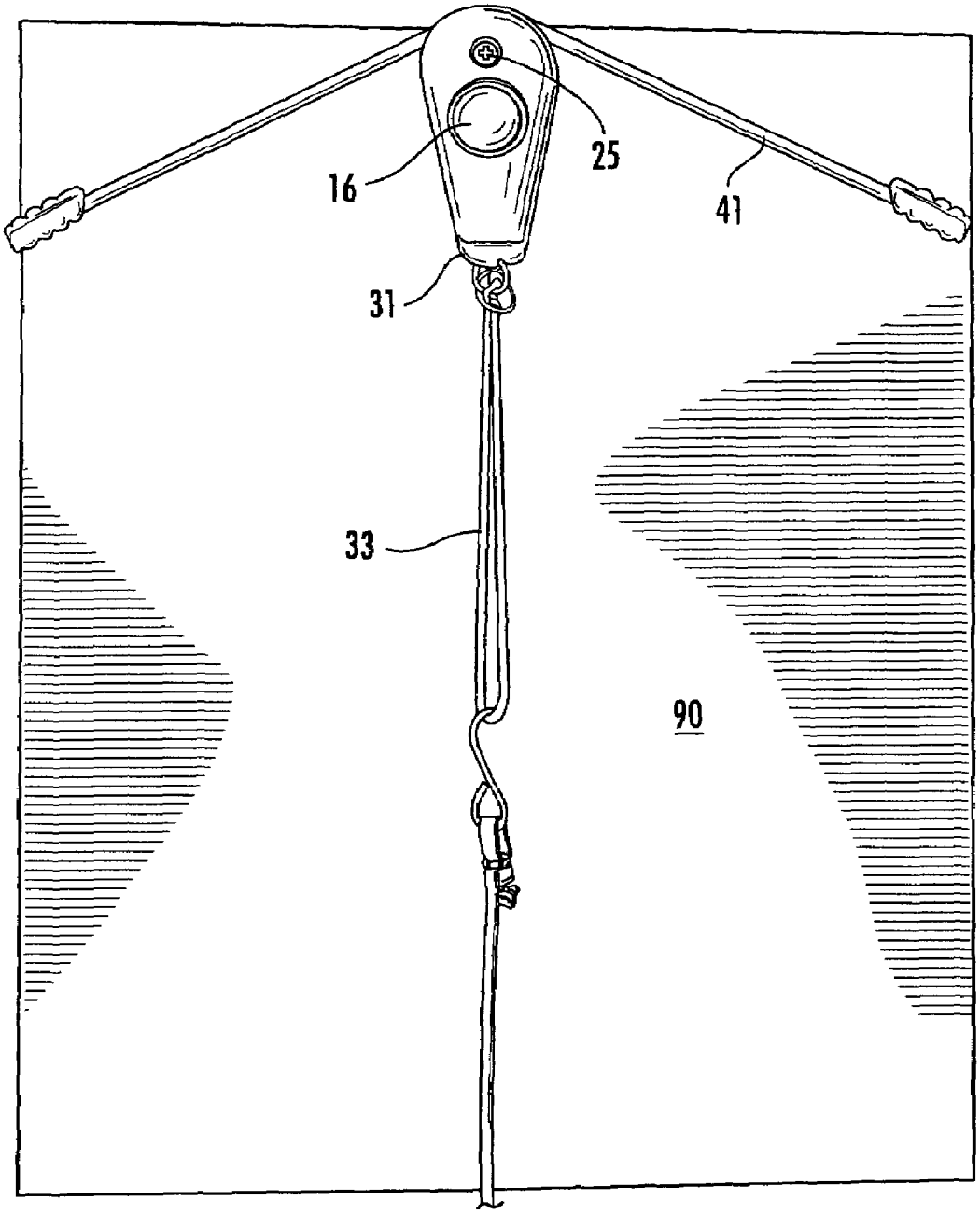
FIG. 9 is a view of an alarm module according to an aspect of the invention showing a picture hung by its hanging wire on the alarm module.

FIG. 9 shows an exemplary embodiment of the alarm module 10 with a hanging device 41 of a display item, such as a picture 90, hung on the alarm module.

Figure 5:
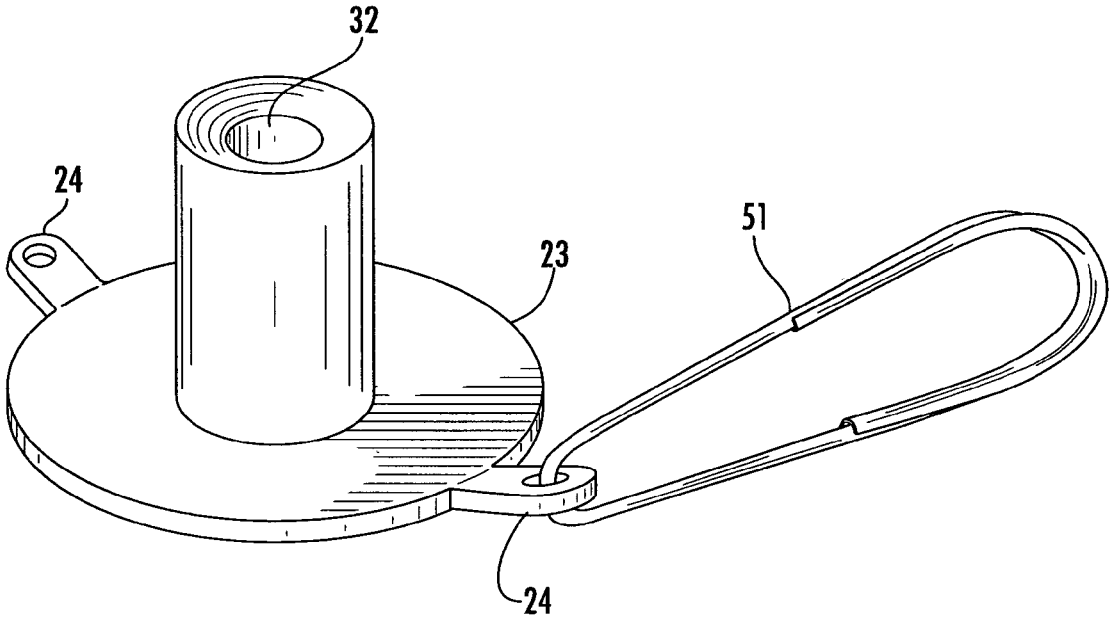
FIG. 5 is a mounting bracket for use with the alarm module according to an aspect of the invention.

FIG. 5 shows an exemplary configuration of the mounting plate 23. The mounting plate may include hanging wire retaining loops 24, which are configured to receive a hanging wire retaining clip 51. The hanging wire retaining clips 51 may be formed from any suitable material, for example spring steel, or the like. The hanging wire retaining clips 51 are configured so that a hanging wire attached to a picture or other display device may be inserted into the interior of the hanging wire retaining clip 51. In this manner, the hanging wire is united with the alarm module 10, so that if an attempt to remove or tamper with the picture or other display item attached to the hanging wire is made the wire retaining clips 51 may present removal of the picture of other display item from the alarm module 10. In addition, since the mounting plate 23 may also contain an opening for receiving a mounting device, such as a screw, the picture or other display item may be secured to its present location by way of the wire retaining clips 51.

Figure 6:
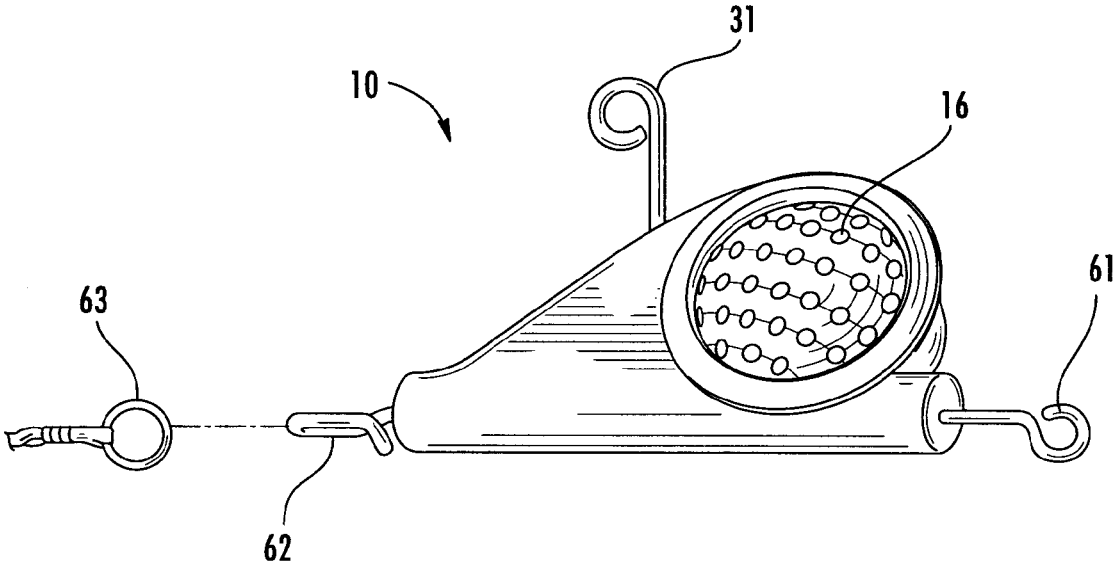
FIG. 6 is an alarm module according to an aspect of the present invention.

FIG. 6 shows another exemplary embodiment of the alarm module 10. The alarm module 10 may contain a device 62, such as a hook or an eyelet for attaching one end of the alarm module 10 to a fastener 63 attached to a wall. The other end of the alarm module 10 may contain a switch-trigger mechanism 61 configured to receive a hanging device, such as a hanging wire for a picture or other display device. The switch-trigger mechanism 61 is operatively coupled to the first switch as discussed in relation to previous embodiments. In addition, the exemplary embodiment shown in FIG. 6 contains elements, such as a key receiving device for receiving the key 31 and a sound generator 16, similar the other exemplary embodiments of the alarm module 10 previously discussed. When a hanging wire or other hanging device is attached to the switch-trigger mechanism 61, the weight of the object, such as a picture or other display item, attached to the hanging wire urges the switch-trigger mechanism 61 away from the alarm module 10. The switch-trigger mechanism 61 operatively coupled to the first switch 11 so that when the switch-trigger mechanism 61 is urged away from the alarm module 10 the first switch 11 is opened. If the weight from the wire is removed, such as if the picture of display object is taken or tampered with, the switch-trigger mechanism 61 moves back towards to the alarm module 10, and the first switch 11 is closed activating the sound generator 16 unless the key 31 is in the key receiving device.

Figure 7:
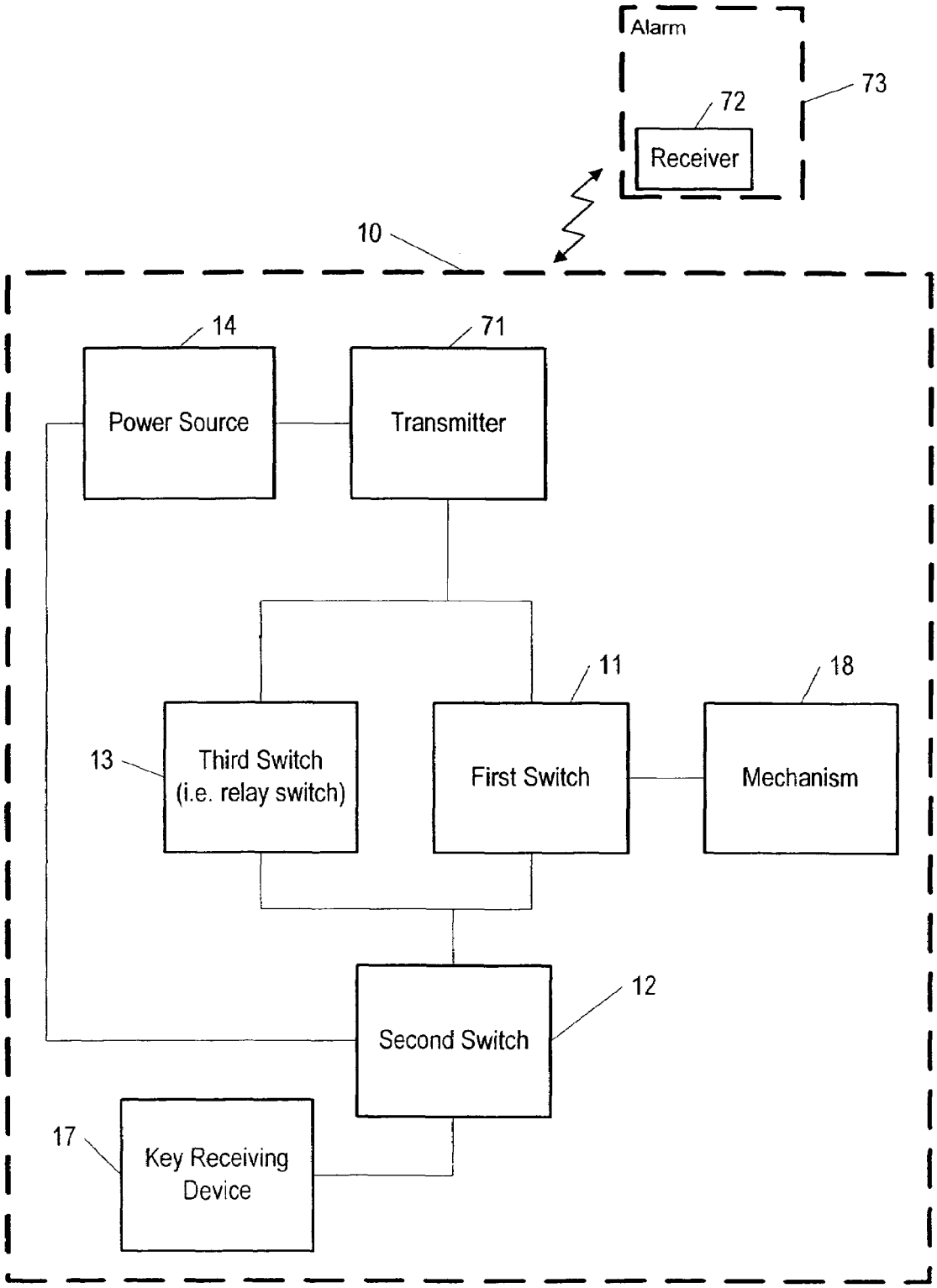
FIG. 7 is an alarm module according to an aspect of the present invention configured to provide a signal to a remote alarm or alarm system.

FIG. 7 shows another exemplary embodiment of the alarm module 10 according to an aspect of the invention. As seen in FIG. 7, the signal module for generating a signal for producing an alarm of the alarm module 10 may be for example a radio frequency transmitter 71, which is configured to send the signal for producing an alarm to a receiver 72. The signal for producing an alarm may be transmitted by a radio frequency carrier, or the like. Upon reception of the signal from the transmitter 71, the receiver 72 is configured to activate an alarm 73 which may be included with the receiver or part of an alarm system. The other elements of the alarm module 10 are similar to those discussed above in the previous embodiments. The transmitter 71 is configured to send the signal to the receiver 72 when the alarm module 10 circuit is completed by closure of the first and second switches, or by closure of the third and second switches. The receiver 72 is coupled to an alarm 73, which may be part of an alarm system, which is activated by the signal received from the transmitter 71. The alarm 73 may generate an audible sound indication possible theft or tampering an item associated with the alarm module, or may also take steps to secure the area around the item associated with the alarm module by locking doors or the like.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An alarm module, comprising:

a first switch operatively connected to a switch-trigger mechanism;

a second switch operatively connected to a key receiving device;

a signal module for generating a signal for producing an alarm; and a third switch configured for connection between the second switch and a power source;

wherein at least said first switch, said second switch, and said signal module are operatively connected to define an electrical circuit;

wherein said first switch is configured to open when a force is applied to said switch-trigger mechanism;

wherein said second switch is configured to open upon insertion of a key in said key receiving; and wherein said third switch is configured to close when the electrical circuit is completed, and configured to open upon insertion of the key in said key receiving device.

2. The alarm module of claim 1, wherein said first switch opens when said force is applied to said switch-trigger mechanism in a direction towards said alarm module.

3. The alarm module of claim 1, wherein said first switch opens when said force is applied to said switch-trigger mechanism in a direction away from said alarm module.

4. The alarm module of claim 1, wherein said signal module comprises an integrated circuit configured to actuate a sound generator.

5. The alarm module of claim 1, further comprising a front cover and a back cover.

6. The alarm module of claim 1, further comprising wire capture clips.

7. The alarm module of claim 1, wherein said switch-trigger mechanism is configured to receive a hanging device.

8. The alarm module of claim 1, further comprising a sound generator, responsive to said signal for producing an alarm, configured to generate a audible sound.

9. The alarm module of claim 8, wherein said sound generator comprises a piezo transducer.

10. The alarm module of claim 1, wherein said signal module comprises a transmitter configured to transmit said signal for producing an alarm.

11. The alarm module of claim 1, further comprising a receiver, responsive to said signal for producing an alarm, configured to activate an alarm.

12. The alarm module of claim 1, wherein said signal for producing an alarm secures at least one locking mechanism.

13. The alarm module of claim 1, wherein said power source comprises at least one battery.

14. The alarm module of claim 1, further comprising a key configured for insertion in said key receiving device.

15. The alarm module of claim 1, further comprising an apparatus configured to receive a mounting device.

16. The alarm module of claim 1, further comprising a mounting plate.

17. The alarm module of claim 1, wherein said signal for producing an alarm is transmitted using a radio frequency carrier.

18. An alarm module, comprising:

first switching means operatively connected to means for actuating said first switching means;

second switching means operatively connected to means for receiving a key;

means for generating a signal for producing an alarm; and third switching means configured for connection between the second switching means and a means for providing power;

wherein at least said first switching means, said second switching means, and said means for generating a signal for producing an alarm are operatively connected to define an electrical circuit;

wherein said first switching means is opened when a force is applied to said means for actuating said first switching means;

wherein said second switching means is opened upon insertion of a key in said means for receiving a key; and wherein said third switching means is configured to close when the electrical circuit is completed, and configured to open upon insertion of the key in said means for receiving a key.

19. An alarm module, comprising:

a first switch operatively connected to a switch-trigger mechanism;

a second switch operatively connected to a key receiving device;

a signal module for generating a signal for producing an alarm; and a third switch configured for connection between the second switch and a power source;

wherein at least said first switch, said second switch, and said signal module are operatively connected to define an electrical circuit;

wherein said switch-trigger mechanism is configured to be depressed by an artwork hanging wire coupled to an artwork, and said first switch is configured to open when said switch-trigger mechanism is depressed;

wherein said alarm module is dimensioned to be positioned between said artwork and a wall surface; and wherein said third switch is configured to close when the electrical circuit is completed, and configured to open upon insertion of the key in said key receiving device.

* * * * *

UNITED STATES PATENT AND TRADEMARK OFFICE

CERTIFICATE OF CORRECTION

PATENT NO. : 7,619,519 B2
APPLICATION NO. : 11/525546
DATED : November 17, 2009
INVENTOR(S) : Robert S. Richter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 477 days.

Signed and Sealed this

Twenty-sixth Day of October, 2010

David J. Kappos

David J. Kappos
*Director of the United States Patent and Trademark Office*